United States Patent [19]

Kramer

[11] Patent Number: 4,658,522

[45] Date of Patent: Apr. 21, 1987

[54] FRAME FOR TENSIONING AND SUPPORTING TEXTILES FOR NEEDLEWORK

[76] Inventor: Monta L. Kramer, Rte. 1 Box 156-A, Parsons, Tenn. 38363

[21] Appl. No.: 834,392

[22] Filed: Feb. 28, 1986

[51] Int. Cl.[4] ..... D06C 3/08; D05C 1/02

[52] U.S. Cl. ..... 38/102.91; 24/339; 160/402; 160/DIG. 15; 242/67.3 F

[58] Field of Search ..... 38/102.91, 102.2, 102.9; 160/380, 378, 377, 401, 402, 383, 399, DIG. 15; 242/67.3 F, 74.2; 135/87, DIG. 9; 24/339; 40/603; 297/441, 218; 5/404

[56] References Cited

U.S. PATENT DOCUMENTS

| | | | |
|---|---|---|---|
| 653,796 | 7/1900 | Ettinger | 242/74.2 |
| 879,654 | 2/1908 | Kohler | 38/102.2 |
| 935,841 | 10/1909 | Fife | 38/102.2 |
| 1,055,489 | 3/1913 | Pendery | 160/380 |
| 2,645,540 | 7/1953 | Trimble et al. | 160/378 |
| 3,885,751 | 5/1975 | Kelch et al. | 242/74.2 X |
| 3,950,869 | 4/1976 | Samarin | 38/102.91 |
| 4,432,381 | 2/1984 | Greenbaum | 135/87 |
| 4,451,997 | 6/1984 | Jones | 160/380 X |
| 4,558,904 | 12/1985 | Schultz | 297/441 |

FOREIGN PATENT DOCUMENTS

| | | | |
|---|---|---|---|
| 121652 | 11/1971 | Denmark | 160/383 |

*Primary Examiner*—Werner H. Schroeder
*Assistant Examiner*—Andrew M. Falik

[57] ABSTRACT

A releasably assembled frame to tension and support textile(s) for needleworkers comprised of pairs of opposite frame rod members, their ends joined together by corner connector means to form a rectangular shape. The frame rod members each have a clamp member, crescent in shape, which fits over said frame rod member to secure textile(s) between the frame rod member and the clamp member.

3 Claims, 4 Drawing Figures

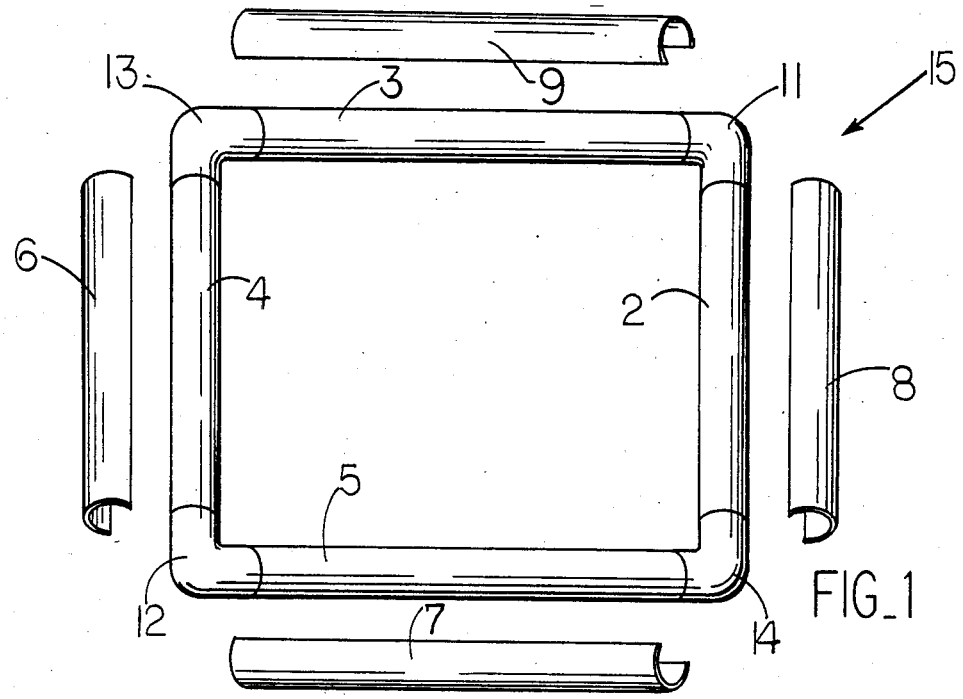
FIG_1
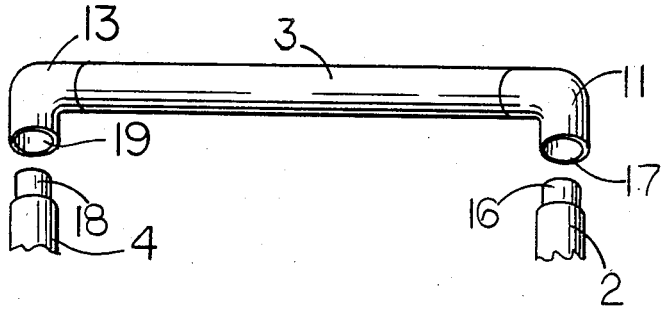
FIG_2
FIG_3
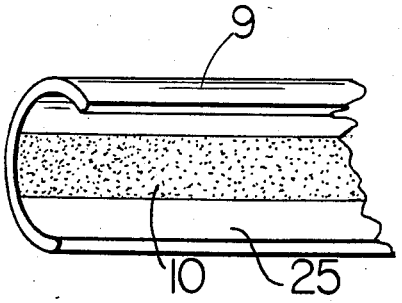
FIG_4
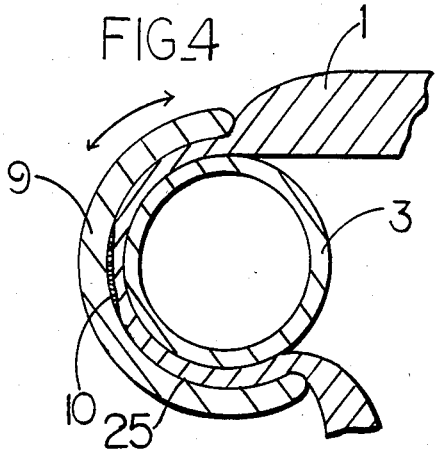

FRAME FOR TENSIONING AND SUPPORTING TEXTILES FOR NEEDLEWORK

BACKGROUND OF THE INVENTION

The current art for tensioning textiles for needlework includes a rectangular frame that requires the textiles be pinned or sewn onto an "apron" fabric that is secured to opposing rails for the frame. Both large or smaller versions of these frames require separate fasteners at their corners, thus involving tedious assembly, and dis-assembly.

The larger version of this type frame is usually recognized as a "quilt frame" around which a number of persons can work. Such frame usually requires two persons to facilitate the rolling of finished areas onto one of the side rails of the frame, to expose unsewn areas to the quilter(s). The size of such frame, as well as the pinning in or sewing in process is difficult for one person to accomplish, and it is time consuming. The drawbacks of need for assistance, plus size, when in use as well as when stored, are evident.

Round and oval hoops are also used to tension textiles for needlework. These are comprised, usually of a base ring and an outer ring. Textile is laid over the base ring and the outer ring is placed over the textile, with varying methods of tightening the outer ring to hold the tension. With the use of such hoops, this tension loosens, as work progresses, requiring the removal of the outer ring, the repositioning of the textile and then replacement of the outer ring. As textile is repositioned, exposing unsewn areas, and needlework progresses to edge of the textile, the circular shape precludes the holding of the straight edge. Hoops, round and oval, typically leave pronounced wrinkles on the textiles.

This invention is directed to the need for a lightweight rectangular shaped frame for tensioning and supporting textile(s) upon which needlework is to be done, and which needlework is best accomplished when consistent tension is maintained. Examples of tensioned needlework being embroidery, crewel work, needlepoint, and quilting. An expressed aspect of this invention is the simple assembly for use; simple dis-assembly to reduce space necessary for storing and transport.

The present invention is based on the recognition of the common problems associated with the prior art of tensioning devices, and my solutions of such problems are applicable for varying sizes of frames.

SUMMARY OF THE INVENTION

The present invention made of lightweight firm tubular plastic, has two end frame rod members, each of which have a connector means at both their ends, permanently attached; two side frame rod members, whose ends attach to the connector means, creating a firm pressure joint, thus forming a rectangular shape. Additionally there is a plurality of clamp members of crescent shape, being over 180 degrees of a circular arc and of appropriate length to their respective frame rod members. Textile(s) are secured between rod members and clamp members, for needlework. A portion of clamps, inner dimension is textured thus creating friction against the textile(s) to aid the maintaining of the integrity of the tension. Tension adjustment is accomplished by the rotation of the clamp member in either direction.

For the purpose of illustrating the invention there is shown in the drawings a form of corner connector means; it being understood, however, that this invention is not limited to this precise form.

BRIEF DESCRIPTION OF DRAWINGS

FIG. 1 is a view of the assembled frame, with clamp members shown in proximity to their respective rod members.

FIG. 2 is a fragmentary view of the disassembled frame rod member 3, with it's attached corner connector means, in proximity to side frame rod members 2 and 4.

FIG. 3 is an enlarged fragmentary view of clamp member 9 indicating textured portion 10 of inner dimension 25.

FIG. 4 is a cross section view representing textile 1 between clamp member 9 and frame rod member 3 indicating compression of textile between them; also indicating contact of textured portion 10 with textile. Arrows indicate rotation of clamp member for tension adjustment.

DESCRIPTION OF THE PREFERRED EMBODIMENTS(S)

Referring to drawing in FIG. 1 a frame for tensioning and supporting textile(s) is designated generally as 15 and shows the frame as assembled. Clamp members 6,7,8, and 9 are shown in proximity to their respective rod members 2,3,4, and 5, onto which they clamp, when in use. For use, textile(s) is laid over frame, clamp members are snapped over textile(s) onto frame rod members, thus securing textile(s) between clamp members and frame rod members.

FIG. 2 represents manner of assembly of side frame rod members, in fragmentary view, into end frame rod member 3 which has at it's ends permanently attached corner connector means 11 and 13. Such permanent attachment eliminates otherwise potential twisting of rectangular shape. FIG. 2 shows fragmentary views of said side frame rod members 2 and 4 whose ends 16 and 18 are to be inserted into corner connector means' ends 17 and 19 forming pressure joints. Such pressure joint providing sufficient means for maintaining the frame members stationery when the clamp members rotate thereon.

Frame rod members, corner connector means and clamp members are preferrably made from lightweight, non-corrosive, smooth surfaced plastic. A portion of the clamps inner dimension is textured.

Specific frame size determines the size of frame rod members' diameter and lengths. Hence clamp members' length and inner dimension is commensorate with frame rods' outer diameter and length. FIG. 3 represents clamp member 9 in fragmentary view, and should be considered representational for all clamp members regardless of specific size.

Clamp members are crescent shaped, being a 200 degree to 210 degree circular arc. FIG. 3 is a fragmentary view of clamp member 9 indicating a portion 10 of it's inner dimension 25 being textured.

When in use, laminant 10 provides friction against textile(s) surface, facilitating the securing of said textile(s) between clamp member and frame rod member. The inner dimension 25 of clamp member is commensorate with the diameter of frame rod member, thus providing means for compression of the textile(s).

The enclarged cross section view in FIG. 4 indicates the compression of textile(s) 1 when clamp member 9 is placed over textile(s) 1 onto frame rod member 3. The inner dimension 25 of clamp member 9 thus compresses the textile(s) onto 200 degrees to 210 degrees of the diameter of the frame rod member 3. Arrow indicates rotatability of clamp member 9, with textured portion 10 which causes textile(s) to move with clamp member 9 as it is rotated. In this view, clockwise rotation loosens tension in the plane of the textile(s) whereas; counterclockwise rotation tightens it.

The present invention may be embodied in widely varying sizes without departing from the spirit or essential attributes thereof and accordingly reference should be made to the claims, indicating the scope of the invention.

I claim:

1. A releaseably assembled frame for tensioning and supporting textile(s) for needlework comprising:

(a) a pair of end frame rod members, of smooth surface and generally tubular in shape, upon whose ends are permanently attached corner connector means, said corner connectors each having an opening at their unattached ends;

(b) a pair of side frame rod members, of smooth surface and generally tubular shaped, wherein the interfacing of their surfaces provide a pressure joint, when inserted one into the other, forming a closed rectangular shape over which textile(s) is laid, for needleworking, and wherein said pressure joints are released for disassembly, when not in use, thereby reducing space requirement of frame's storage and transport;

(c) a plurality of cresent shaped clamp members providing means for securing said textile(s) to said frame, wherein said clamp members are snap fitted over said rod members, onto which said textile(s) has been laid, to rotate thereon and tightly grip that portion of textile(s) which passes between the interfacing surface of the clamp member and rod member, wherein the amount of tension in the plane of the textile(s), in said frame, can be changed by rotation of said clamp member about said relatively stationery rod member.

2. The frame as described in claim 1, wherein each clamp member is over 180 degrees of a circular arc.

3. The frame as described in claim 2, wherein a portion of each clamp member's inner dimension is textured providing friction against said textile(s) when such is secured between the textured inner surface of said clamp member and the smooth surface of said rod member, thereby forcing said textile(s) to move with said clamp member when it is rotated about said relatively stationery rod member.

* * * * *

UNITED STATES PATENT AND TRADEMARK OFFICE

CERTIFICATE OF CORRECTION

PATENT NO. : 4,658,522
DATED : April 21, 1987
INVENTOR(S) : Monta L. Kramer

It is certified that error appears in the above-indentified patent and that said Letters Patent is hereby corrected as shown below:

Claim 1, column 3, line 26 delete "inserted one into the other" and substitute --said rod members inserted into said corner connector means' openings---.

Signed and Sealed this

Twenty-fourth Day of October, 1995

*Attest:*

*Attesting Officer*

BRUCE LEHMAN

*Commissioner of Patents and Trademarks*